US012552429B2

(12) United States Patent
Jiang et al.

(10) Patent No.: US 12,552,429 B2
(45) Date of Patent: Feb. 17, 2026

(54) TRAIN OPERATION CONTROL SYSTEM AND METHOD BASED ON TRAIN-GROUND COORDINATION

(71) Applicant: CASCO SIGNAL LTD., Shanghai (CN)

(72) Inventors: Jianhua Jiang, Shanghai (CN); Haigui Xu, Shanghai (CN); Yajing Zhang, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 658 days.

(21) Appl. No.: 18/013,265

(22) PCT Filed: Nov. 4, 2021

(86) PCT No.: PCT/CN2021/128597
§ 371 (c)(1),
(2) Date: Dec. 28, 2022

(87) PCT Pub. No.: WO2022/142715
PCT Pub. Date: Jul. 7, 2022

(65) Prior Publication Data

US 2023/0257010 A1 Aug. 17, 2023

(30) Foreign Application Priority Data

Dec. 30, 2020 (CN) ..... 202011620849.0

(51) Int. Cl.
*B61L 27/20* (2022.01)
*B61L 15/00* (2006.01)
(Continued)

(52) U.S. Cl.
CPC ..... *B61L 27/20* (2022.01); *B61L 15/0018* (2013.01); *B61L 15/0027* (2013.01);
(Continued)

(58) Field of Classification Search
CPC ..... B61L 27/20; B61L 15/0027; B61L 2027/204; B61L 27/04; B61L 27/40;
(Continued)

(56) References Cited

U.S. PATENT DOCUMENTS

2018/0346005 A1* 12/2018 Yanai ..... B61L 23/14
2019/0054940 A1* 2/2019 Gao ..... B61L 25/04
(Continued)

FOREIGN PATENT DOCUMENTS

CN 107054413 A * 8/2017 ..... B61L 27/04
CN 107284471 A * 10/2017 ..... H04W 12/06
(Continued)

OTHER PUBLICATIONS

CN 111497896 A machine translation (Year: 2020).*

*Primary Examiner* — Zachary L Kuhfuss
(74) *Attorney, Agent, or Firm* — JCIPRNET

(57) ABSTRACT

A train operation control system and method based on train-ground coordination are provided. The system includes a dispatching center server, a resource management unit (RMU) for ground train control equipment, and on-board train control equipment (CC), wherein the dispatching center server is connected via communication to the on-board CC, and the on-board CC is connected via communication to the RMU for the ground train control equipment; and the RMU for the ground train control equipment and the on-board CC coordinatively complete resource management and implement train operation control, wherein the resource management is divided into two levels, at a first level, the RMU is responsible for performing the resource management in the unit of section, and at a second level, a preceding train and a succeeding train interact with each other via direct train-to-train communication, such that finer resource sharing in a section is achieved between the trains.

7 Claims, 3 Drawing Sheets

(51) Int. Cl.

| | |
|---|---|
| ***B61L 25/02*** | (2006.01) |
| ***B61L 27/10*** | (2022.01) |
| ***B61L 27/40*** | (2022.01) |
| ***B61L 27/70*** | (2022.01) |

(52) U.S. Cl.
CPC ..... *B61L 25/025* (2013.01); *B61L 27/10* (2022.01); *B61L 27/40* (2022.01); *B61L 27/70* (2022.01); *B61L 2201/00* (2013.01); *B61L 2205/00* (2013.01)

(58) Field of Classification Search
CPC ..... B61L 27/70; B61L 23/14; B61L 99/002; B61L 15/0018; B61L 15/0072; B61L 15/0062; B61L 2201/00; B61L 2205/00; B61L 27/16; B61L 19/06
USPC ..... 701/19
See application file for complete search history.

(56) References Cited

U.S. PATENT DOCUMENTS

| | | | | |
|---|---|---|---|---|
| 2019/0111953 | A1* | 4/2019 | Gao | B61L 3/08 |
| 2020/0406943 | A1* | 12/2020 | Xia | B61L 15/0027 |
| 2022/0227402 | A1* | 7/2022 | Xu | B61L 15/0027 |

FOREIGN PATENT DOCUMENTS

| | | | | |
|---|---|---|---|---|
| CN | 111497896 A | * | 8/2020 | B61L 1/18 |
| KR | 20190042962 A | * | 4/2019 | B61L 23/14 |

* cited by examiner

TRAIN OPERATION CONTROL SYSTEM AND METHOD BASED ON TRAIN-GROUND COORDINATION

CROSS-REFERENCE TO RELATED APPLICATION

This application is a 371 of international application of PCT application serial no. PCT/CN2021/128597, filed on Nov. 4, 2021, which claims the priority benefit of China application no. 202011620849.0, filed on Dec. 30, 2020. The entirety of each of the above-mentioned patent applications is hereby incorporated by reference herein and made a part of this specification.

BACKGROUND

Technical Field

The present invention relates to a train signal control system, and, in particular, to a train operation control system and method based on train-ground coordination.

Description of Related Art

At present, train operation control systems for railway or urban rail transit, no matter the China train control system (CTCS) for high-speed trains or the communication-based train control (CBTC) system for urban rail transit, are mainly based on a control method including performing train route management on the ground, calculating a movement authority, and sending the movement authority to a train. With this method, train routes are under an extensive ground control, which does not allow fine resource management and sharing and does not take full advantage of resources; then, all resources are managed at a ground level, which increases the complexity in resource management of ground equipment and increases the difficulty in implementation; and in addition, the method for train route management on the ground affects the timeliness of resource management, which is unfavorable for improving the operation efficiency of trains.

SUMMARY

An object of the present invention is to overcome the defects existing in the above prior art and to provide a train operation control system and method based on train-ground coordination, in order to achieve the safe and efficient control over the operation of trains.

The object of the present invention can be achieved by means of the following technical solutions.

According to one aspect of the present invention, there is provided a train operation control system based on train-ground coordination, including a dispatching center server, a resource management unit (RMU) for ground train control equipment, and on-board train control equipment (CC), wherein the dispatching center server is connected via communication to the on-board CC, and the on-board CC is connected via communication to the RMU for the ground train control equipment; and the RMU for the ground train control equipment and the on-board CC coordinatively complete resource management and implement train operation control, wherein the resource management is divided into two levels, at a first level, the RMU is responsible for performing the resource management in the unit of section, and at a second level, a preceding train and a succeeding train interact with each other via direct train-to-train communication, such that finer resource sharing in a section is achieved between the trains.

As a preferred technical solution, the dispatching center server is responsible for supervising and controlling train operation and has functions of train operation tracking, alarming and event reporting, operation plan adjusting, and operation controlling.

As a preferred technical solution, the RMU for the ground train control equipment is responsible for allocating and recovering line resources and turnout resources and for turnout locking and unlocking management.

As a preferred technical solution, the line resources are in the unit of track circuit or virtual track circuit.

As a preferred technical solution, the on-board CC is responsible for applying, using, and releasing the line resources and the turnout resources, for locking and unlocking turnouts, and for performing train-to-train communication with the preceding and succeeding trains to implement resource sharing.

As a preferred technical solution, the resource sharing between the on-board CC and the preceding and succeeding trains is completed by fine management of the line resources and the turnout resources.

As a preferred technical solution, with respect to section resources and the turnout resources, the preceding and succeeding trains directly perform position information interaction and mutual negotiation to subdivide an application range of the resources.

As a preferred technical solution, the turnout resources are specifically subdivided as follows:

dividing resources of a turnout P1 into a P1-pre-turnout zone, a P1-turnout movable zone, a P1-forward side defense zone, a P1-reverse side defense zone, a P1-forward post-turnout zone, and a P1-reverse post-turnout zone.

As a preferred technical solution, the subdivided resources are specifically managed as follows:

a) each subdivided zone is the smallest unit for train occupancy and clearance, can be occupied by one train each time, and can be occupied by another train after train clearance;

b) the P1-forward side defense zone and the P1-reverse side defense zone are mutually exclusive in terms of occupancy, and only one of the two can be occupied each time; and c) the P1-turnout movable zone can be unlocked by a train originally applying for locking and can be applied and operated by an additional train, as long as the P1-turnout movable zone is not occupied.

According to another aspect of the present invention, there is provided a method for controlling the train operation control system based on train-ground coordination as defined. The method includes the following steps:

1) first, managing, by the RMU for the ground train control equipment, the line resources and the turnout resources by section;

2) then, performing communication between on-board CC of adjacent trains, and performing fine management on resources in a section to implement resource sharing between the trains; and 3) finally, actively performing train control by the on-board CC according to the allocated resources to fulfill a train safety protection function and an automatic train driving function.

Compared with the prior art, the present invention has the following advantages:

1) the present invention realizes the full utilization of line resources, turnout resources and the like by performing hierarchical management and fine processing on the line resources and by sharing the resources based on train-to-train communication, which improves the passing capacity of lines while improving the utilization rate of resources;
2) the present invention reduces the time of information flow and system response on the basis of resource coordination based on train-to-train communication, autonomous train location and autonomous train control, which improves system effectiveness;
3) the resource management method based on train-ground coordination of the present invention simplifies the interface and communication between the trains and the ground train control equipment, which can reduce ground trackside equipment, making the system simpler;
4) the train-ground coordination of the present invention can maximize the compatibility with the existing train operation control methods to achieve the compatibility between the high-efficiency train control system based on train-to-train communication and existing control modes, and also supports a corresponding backup mode; and
5) the present invention has universality and is applicable to railway and urban rail transit, providing the foundation for a unified control method in the future.

DESCRIPTION OF THE EMBODIMENTS

The technical solutions in the embodiments of the present invention will be described clearly and completely below in conjunction with the accompanying drawings in the embodiments of the present invention. Obviously, the embodiments described are some instead of all of the embodiments of the present invention. Based on the embodiments in the present invention, every other embodiment obtained by those of ordinary skills in the art without creative labor shall fall within the protection scope of the present invention.

The train operation control system based on train-ground coordination includes the followings.

1. In this train operation control system, a resource management unit (RMU) for ground train control equipment and on-board train control equipment (CC) coordinatively complete resource management and implement train operation control. The resource management is divided into two levels. At a first level, the RMU is responsible for performing the resource management in the unit of section, and at a second level, a preceding train and a succeeding train interact with each other via direct train-to-train communication, such that finer resource sharing in a section is achieved between the trains.

2. The RMU is responsible for allocating and recovering line resources (which may be in the unit of track circuit or virtual track circuit) and turnout resources, and also for turnout locking and unlocking management.

The CC is responsible for applying, using, and releasing the line resources and the turnout resources, for locking and unlocking turnouts, and for performing train-to-train communication with the preceding and succeeding trains to implement resource sharing.

4. The resource sharing between the CC and the preceding and succeeding trains is completed by fine management of the lien resources and the turnout resources. With respect to section resources and the turnout resources, the preceding and succeeding trains directly perform position information interaction and mutual negotiation to subdivide an application range of the resources.

5. A train control method based on train-ground coordination is applicable to railway or urban rail transit, showing universality.

Description of the Embodiments

Figure 1:
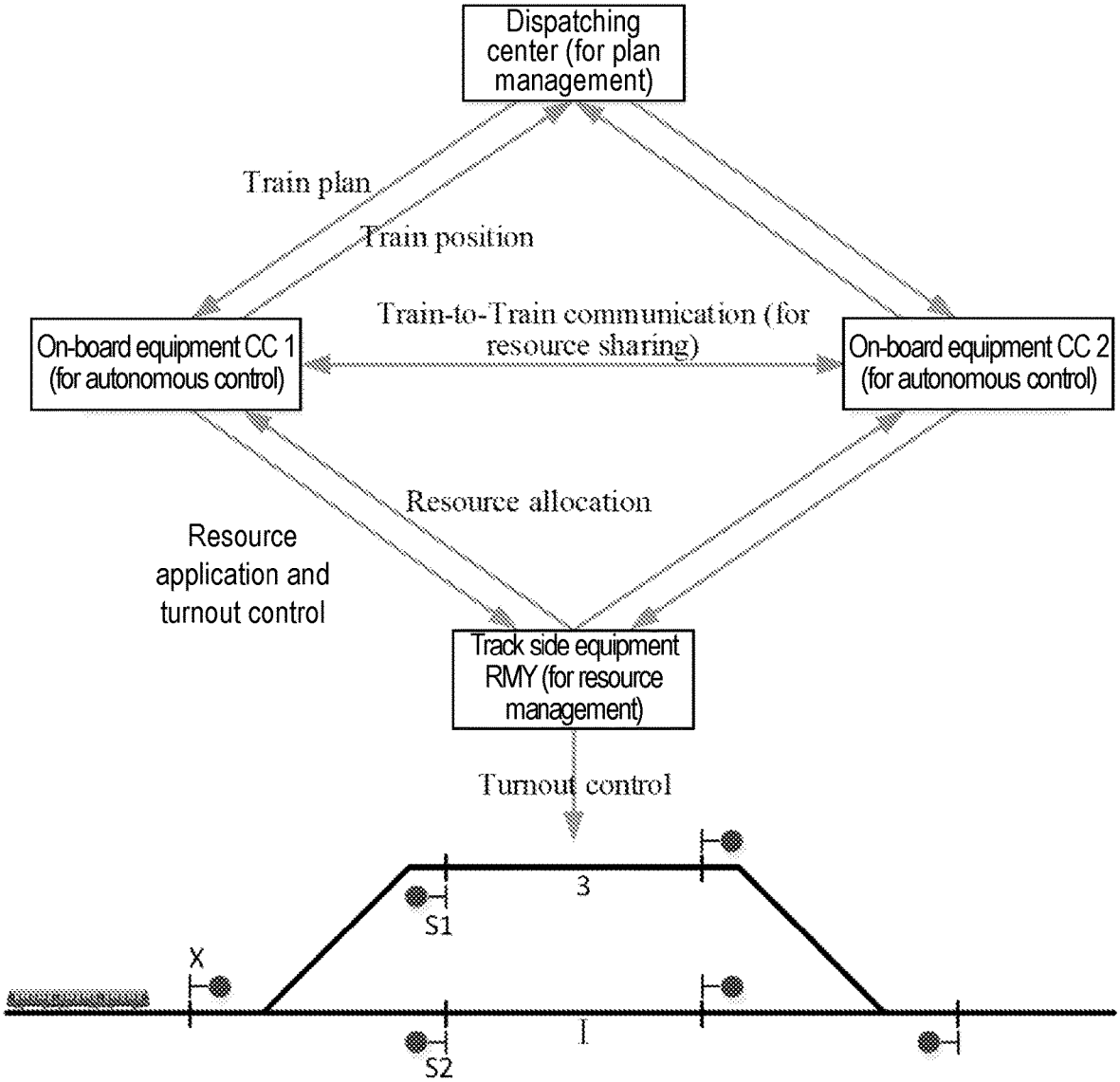
FIG. 1 is a schematic diagram of an overall architecture of a train operation control system based on train-ground coordination according to the present invention.

The structure and interface information of the train operation control system based on train-ground coordination are shown in FIG. 1. The system includes a dispatching center, a resource management unit (RMU) for ground train control equipment, and on-board train control equipment (CC). The dispatching center is responsible for supervising and controlling train operation, and has functions such as train operation tracking, alarming and event reporting, operation plan adjusting, and operation controlling. The RMU is responsible for allocating and recovering line resources and turnout resources and for acquiring information from and driving trackside equipment. The CC is responsible for requesting and releasing the line resources according to a plan, communicating with adjacent trains for resource sharing, and actively performing train control according to the allocated resources to fulfill a train safety protection function and an automatic train driving function.

Figure 2:
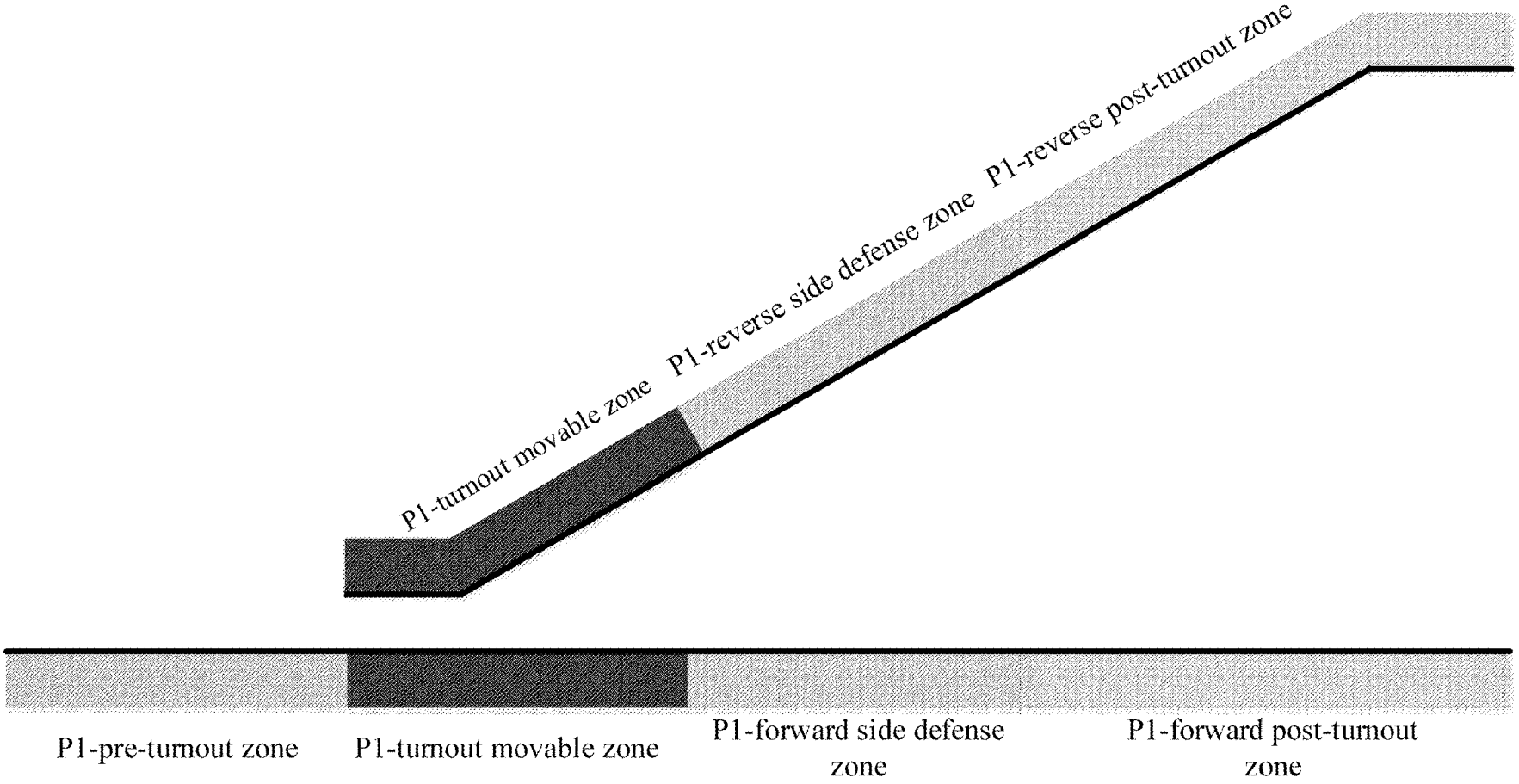
FIG. 2 is a schematic diagram of subdivided resources of a turnout P1 according to the present invention.

In the train operation control system based on grain-ground coordination, the management of turnout resources is fined (as shown in FIG. 2). The resources of a turnout P1 into a P1-pre-turnout zone, a P1-turnout movable zone, a P1-forward side defense zone, a P1-reverse side defense zone, a P1-forward post-turnout zone, and a P1-reverse post-turnout zone. The subdivided resources are management under the following rules:

1) each subdivided zone is the smallest unit for train occupancy and clearance, can be occupied by one train each time, and can be occupied by another train after train clearance;
2) the P1-forward side defense zone and the P1-reverse side defense zone are mutually exclusive in terms of occupancy, and only one of the two can be occupied each time; and
3) the P1-turnout movable zone can be unlocked by a train originally applying for locking and can be applied and operated by an additional train, as long as the P1-turnout movable zone is not occupied.

Figure 3:
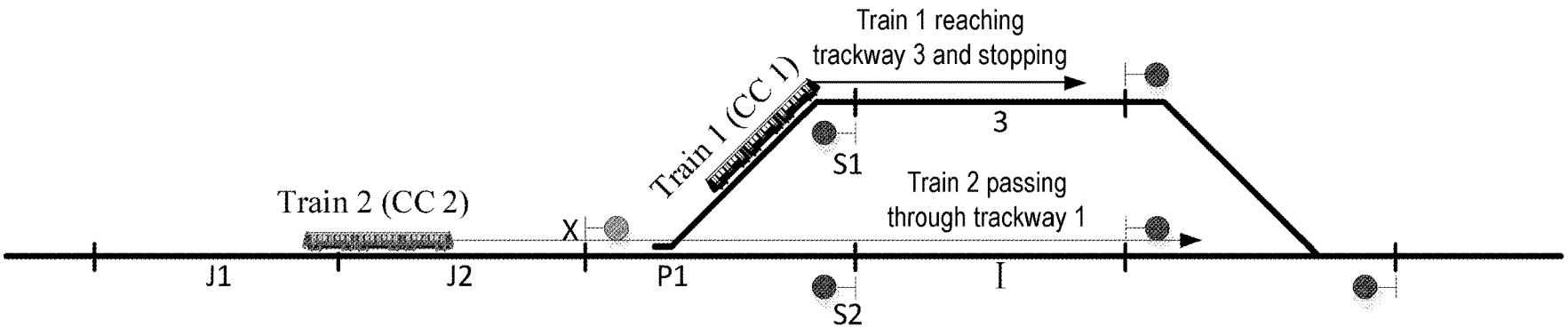
FIG. 3 is a schematic diagram showing operation tracking of two trains according to the present invention.

Referring to FIG. 3, it shows a practical application example, in which a train 1 reaches a trackway 3 via the turnout P1 and stops, a train 2 passes a trackway I via the turnout P1, and a following distance between the two trains is short, possibly leading to moving block. The instantaneous situation in the figure is as follows: the train 1 has crossed the P1-reverse side defense zone and is heading to stop at the trackway 3; and the train 2 occupies track circuits J1 and J2, the turnout P1 has been locked at a normal position, a receiving route of the train 2 has been prepared, and the train 2 is planned to pass via the trackway I. In FIG. 3, the resources of interest mainly include: G-J1, G-J2, G-P1, G-I and G-3.

Table 1 shows the examples of resource management in respective steps during the operation of the trains 1 and 2. The main situation is as follows.

In step 1, the train 1 is located on the track G-J2, with the turnout P1 locked at a reverse position and a receiving signal X cleared; and the train 2 approaches a track G-J1.

In step 2, the train 1 occupies G-J2 and G-P1; and the train 2 occupies the track G-J1.

In step 3, the train 1 is cleared from the track G-J2 and occupies G-P1 to cross the movable zone of the turnout P1; and the train 2 occupies the track circuits G-J1 and G-J2.

In step 4, the train 1 occupies G-P1 to cross the reverse side defense region of the turnout P1; and the train 2 occupies G-J1 and G-J2, with its receiving signal X cleared.

In step 5, the train 1 occupies G-3; and the train 2 occupies G-J2 and G-P1, as well as the normal position of the turnout P1.

The resource management in step 4 (as shown in FIG. 3 correspondingly) is described as follows.

A. Resource Management at RMU

The RMU maintains the allocation of the resources G-P1 and G-3 to on-board CC 1, and maintains the allocation of G-J1 and G-J2 to the on-board CC 2, and the on-board CC 1 maintains the allowance of sharing G-P1 with the on-board CC 2; G-P1 is occupied by the on-board CC 1, and G-J1 and G-J2 are occupied by the on-board CC 2; and the turnout P1 is locked at the normal position by the on-board CC 2.

B. Resource Management at On-Board CC 1

The on-board CC 1 is cleared from the P1-reverse side defense zone, and occupies the P1-reverse post-turnout zone; the on-board CC 1 releases the P1-reverse side defense zone; and the on-board CC 1 allows sharing the track G-P1 with the on-board CC 2.

C. Resource Management at On-Board CC 2

The on-board CC 2 obtains the allocation of and occupies G-J1 and G-J2, and obtains the allowance of sharing G-P1 from the on-board CC 1; and the turnout P1 is locked to the normal position by the RMU.

In the case of step 4, the resource management at the RMU, on-board CC 1, and on-board CC 2 is shown Table 2, Table 3, and Table 4.

TABLE 1

System resource management

| | Train position description | Resource management at RMU | Resource management at on-board CC 1 | Resource management at on-board CC 2 |
|---|---|---|---|---|
| Step 1 | The train 1 is located on the track G-J2, with the turnout P1 locked at the reverse position and a receiving signal X cleared; and the train 2 approaches the track G-J1 | The RMU maintains the allocation of the resources G-J2, G-P1, and G-3 to the on-board CC 1, with G-J2 occupied by the on-board CC 1; the turnout P1 is locked by the on-board CC 1 at the reverse position; and the RMU maintains the allocation of G-J1 to the on-board CC 2 | The on-board CC 1 obtains the allocation of G-J2 from the RMU and occupies the G-J2; the on-board CC 1 obtains the allocation of the turnout P1-pre-turnout zone, the P1-turnout movable zone, the P1-reverse side defense zone, and the P1-reverse post-turnout zone; the turnout P1 is locked to the reverse position by means of the RMU; and the on-board CC 1 obtains the allocation of G-3 | The on-board CC 2 obtains the allocation of the track G-J1 from the RMU |
| Step 2 | The train 1 occupies G-J2 and G-P1; and the train 2 occupies the track G-J1 | The RMU maintains the allocation of the resources G-J2, G-P1, and G-3 to the on-board CC 1, and maintains the allocation of G-J1 to the on-board CC 2; and the on-board CC 1 allows sharing G-J2 with the on-board CC 2; G-J2 and G-P1 are occupied by the on-board CC 1, and G-J1 is occupied by the on-board CC 2; and the turnout P1 is locked at the reverse position by the on-board CC 1 | The on-board CC 1 obtains the allocation of and occupies G-J2 and the pre-turnout zone of the turnout P1, and obtains the allocation of the P1-turnout movable zone, the P1-reverse side defense zone, the P1-reverse post-turnout zone, and G-3; the turnout P1 is locked at the reverse position by by means of the RMU; and the on-board CC 1 allows the sharing of G-J2 with the on-board CC 2 | The on-board CC 2 obtains the allocation of and occupies the track G-J1, and obtains the allowance of sharing teh track G-J2 with the on-board CC 1 |
| Step 3 | The train 1 is cleared from the track G-J2 and occupies G-P1 to cross the movable zone of the turnout P1; and the train 2 occupies the track circuits G-J1 and G-J2 | The RMU maintains the allocation of the resources G-P1 and G-3 to the on-board CC 1, and maintains the allocation of G-J1 to the on-board CC 2; G-J2 is handed over to the on-board CC 2 from the on-board CC 1; the on-board CC 1 allows sharing G-P1 with the on-board CC 2; G-P1 is occupied by the on-board CC 1, and G-J1 and G-J2 are occupied by the on-board CC 2; and the turnout P1 is at the reverse position without being locked | The on-board CC 1 is cleared from G-J2, then from the pre-turnout zone of the turnout P1 and the P1-turnout movable zone, occupies the P1-reverse side defense zone and the P1-reverse post-turnout zone, and obtains the allocation of G-3; the on-board CC 1 unlocks the turnout P1 by means of the RMU and releases the turnout movable zone; and the on-board CC 1 allows sharing the track G-P1 with the on-board CC 2 | The on-board CC 2 obtains the allocation of and occupies the tracks G-J1 and G-J2, and obtains the allowance of sharing the track G-P1 from the on-board CC 1; and the on-board CC1 shifts the turnout P1 to the normal position by means of the RMU |

TABLE 1-continued

| System resource management | | | | |
|---|---|---|---|---|
| | Train position description | Resource management at RMU | Resource management at on-board CC 1 | Resource management at on-board CC 2 |
| Step 4 | The train 1 occupies G-P1 to cross the reverse side defense region of the turnout P1; and the train 2 occupies G-J1 and G-J2, with its receiving signal X cleared | The RMU maintains the allocation of the resources G-P1 and G-3 to the on-board CC 1, and maintains the allocation of G-J1 and G-J2 to the on-board CC 2, and the on-board CC 1 maintains the allowance of sharing G-P1 with the on-board CC 2; G-P1 is occupied by the on-board CC 1, and G-J1 and G-J2 are occupied by the on-board CC 2; and the turnout P1 is locked at the normal position by the on-board CC 2 | The on-board CC 1 is cleared from the P1-reverse side defense zone, occupies the P1-reverse post-turnout zone, and obtains the allocation of G-3; the on-board CC 1 releases the P1-reverse side defense zone; and the on-board CC 1 allows sharing the track G-P1 with the on-board CC 2 | The on-board CC 2 obtains the allocation of and occupies G-J1 and G-J2, and obtains the allowance of sharing G-P1 from the on-board CC 1; and the turnout P1 is locked to the normal position by the means of the RMU |
| Step 5 | The train 1 occupies G-3; and the train 2 occupies G-J2 and G-P1, as well as the normal position of the turnout P1. | The RMU maintains the allocation of the resource G-3 to the on-board CC 1, and maintains the allocation of G-J2 to the on-board CC 2, and the allocation of G-P1 to the on-board CC 1; G-3 is occupied by the on-board CC 1, and G-J2 and G-P1 are occupied by the on-board CC 2; and the turnout P1 is locked at the normal position by the on-board CC 2 | The on-board CC 1 is cleared from the P1-reverse post-turnout zone, hands over G-P1 to the on-board CC 2, and maintains the allocation of and occupies the obtained G-3 | The on-board CC 2 obtains the allocation of and occupies G-P1 and the P1-pre-turnout zone, and obtains the allocation of and occupies G-J2; and the turnout P1 is locked to the normal position by means of the RMU |

TABLE 2

| | Resource name | | | | | | | | | |
|---|---|---|---|---|---|---|---|---|---|---|
| | G-J1 | | G-J2 | | G-P1 | | | | | |
| | Characteristic | 1000 m | | 1000 m | | 500 m | G-I | | G-3 | |
| Resource state | parameters (for example, length) State | Allocated and occupied | Characteristic parameters State | Allocated and occupied | Characteristic parameters State | Allocated and occupied | Characteristic parameters State | 450 m allocated and idle | Characteristic parameters State | 450 m allocated and idle |
| | User Shared or not Sharer | CC2 NO None | User Shared or not Sharer | CC2 NO None | User Shared or not Sharer Turnout position Locked or not | CC1 YES CC2 Normal position YES | User Shared or not Sharer | CC2 NO None | User Shared or not Sharer | CC1 NO None |

TABLE 3

| | Resource name G-P1 | | | | | | | | |
|---|---|---|---|---|---|---|---|---|---|
| | Basic state | | Tracking condition | | Shunting condition | | | | |
| Re-source state | State | Allocated and occupied | Current train region | 400 m ahead | P1-pre-turnout zone | | P1-turnout movable zone | | P1-forward side defense zone |
| | Suc-ceeding train tracking and shunting | Shunting | Shared or not | NO | Length | 100 m | Length | 12 m | Length |

TABLE 3-continued

| | | | | | | | | | |
|---|---|---|---|---|---|---|---|---|---|
| | Turnout position | Normal position | Sharer | None | Occupied or not | NO | Occupied or not | NO | Occupied or not |
| | Locked or not | YES | Succeeding train region | None | Occupier | None | Occupier | None | Occupier |
| | Controller | CC2 | | | Shared or not Sharer | YES CC2 | Shared or not Sharer | YES CC2 | Shared or not Sharer |

| | Resource name | | | | | | | | |
|---|---|---|---|---|---|---|---|---|---|
| | | | | | | | | G-3 | |
| | G-P1 Shunting condition | | | | | | | State | allocated and idle |
| Resource state | P1-forward side defense zone | P1-reverse side defense zone | | P1-forward post-turnout zone | | P1-reverse post-turnout zone | | Current train region | 450 mm in total |
| | 48 m | Length | 48 m | Length | 340 m | Length | 340 m | Shared or not | NO |
| | NO | Occupied or not | NO | Occupied or not | NO | Occupied or not | YES | Sharer | None |
| | None | Occupier | None | Occupier | None | Occupier | CC1 | Succeeding train region | None |
| | YES | Shared or not | NO | Shared or not | YES | Shared or not | NO | | |
| | CC2 | Sharer | None | Sharer | CC2 | Sharer | None | | |

TABLE 4

| | Resource name | | | | | | | | | | |
|---|---|---|---|---|---|---|---|---|---|---|---|
| | | | G-T2 | | | | | | | | |
| | G-T1 | | | Allocated | | | | | | | |
| | | Allocated | | and | G-P1 | | | | | | |
| | State | and occupied | State | occupied 1000 | Basic state | | Tracking condition | | Shunting condition | | |
| Resource state | Current train region | 200 m ahead | Current train region | mm in total | State | Shared and occupied | Current train region | 400 m ahead | P1-pre-turn out zone | | P1-turnout movable zone |
| | Shared or not | NO | Shared or not | NO | Succeeding train tracking | Shunting | Shared or not | NO | Length | 100 m | Length |
| | Sharer | None | Sharer | None | Turnout position | Normal position | Sharer | None | Occupied or not | NO | Occupied or not |
| | Succeeding train region | None | Succeeding train region | None | Locked or not | YES | Succeeding train region | None | Occupier | None | Occupier |
| | | | | | Controler | CC2 | | | Shared or not Sharer | YES CC2 | Shared or not Sharer |

TABLE 4-continued

| | Resource name | | | | | | | | | | |
|---|---|---|---|---|---|---|---|---|---|---|---|
| | | | | | | | | | | G-I | |
| | G-P1 Shunting condition | | | | | | | | | | allocated and idle |
| Re-source state | P1-turnout movable zone | P1-forward side defense zone | | P1-reverse side defense zone | | P1-forward post-turnout zone | | P1-reverse post-turnout zone | | State Current train region | 450 mm in total |
| | 12 m | Length | 48 m | Length | 48 m | Length | 340 m | Length | 340 m | Shared or not | NO |
| | NO | Occupied or not | NO | Occupied or not | NO | Occupied or not | NO | Occupied or not | | Sharer | None |
| | None | Occupier | None | Occupier | None | Occupier | None | Occupier | CC1 | Succeeding train region | None |
| | YES | Shared or not | YES | Shared or not | NO | Shared or not | YES | Shared or not | NO | | |
| | CC2 | Sharer | CC2 | Sharer | None | Sharer | CC2 | Sharer | None | | |

Table 1 is a table showing the processing steps of resource management of the train operation control system based on train-ground coordination.

Table 2 is a resource management list of RMU.

Table 3 is a resource sharing list of CC 1.

Table 4 is a resource sharing list of CC 2.

Based on the analysis of resource management, the train operation control system based on train-ground coordination performs hierarchical management on the line resources and turnout resources. First, the RMU manages the line resources and turnout resources by section, adjacent trains then communicate with each other, and fine management is performed on resources in the section to achieve resource sharing between the trains, which makes the best of the line resources and turnout resources and improves the passing capacity of the lines.

The above description only provides the specific embodiments of the present invention, but the protection scope of the present invention is not limited thereto. A variety of equivalent modifications or substitutions readily conceivable to a person skilled in the art within the technical scope disclosed by the present invention should be included within the protection scope of the present invention. Therefore, the protection scope of the present invention should be subjected to the protection scope of the claims.

What is claimed is:

1. A train operation control system based on train-ground coordination, comprising a dispatching center server, a resource management unit RMU for ground train control equipment, and an on-board train control equipment CC, wherein the dispatching center server is connected via communication to the on-board CC, and the on-board CC is connected via communication to the RMU for the ground train control equipment; and the RMU for the ground train control equipment and the on-board CC coordinatively complete resource management and implement train operation control, wherein the resource management is divided into two levels, wherein at a first level, the RMU is responsible for performing the resource management in an unit of section, and at a second level, a preceding train and a succeeding train interact with each other via a direct train-to-train communication, such that finer resource sharing in a section is achieved between the trains, wherein the on-board CC is responsible for applying, using, and releasing line resources and turnout resources, for locking and unlocking turnouts, and for performing train-to-train communication with the preceding and succeeding trains to implement resource sharing, wherein the resource sharing between the on-board CC and the preceding and succeeding trains is completed by fine management of the line resources and the turnout resources, wherein with respect to section resources and the turnout resources, the preceding and succeeding trains directly perform position information interaction and mutual negotiation to subdivide an application range of the resources.

2. The train operation control system based on train-ground coordination according to claim 1, wherein the dispatching center server is responsible for supervising and controlling train operation and has functions of train operation tracking, alarming and event reporting, operation plan adjusting, and operation controlling.

3. The train operation control system based on train-ground coordination according to claim 1, wherein the RMU for the ground train control equipment is responsible for allocating and recovering the line resources and the turnout resources and for turnout locking and unlocking management.

4. The train operation control system based on train-ground coordination according to claim 3, wherein the line resources are in the unit of track circuit or virtual track circuit.

5. The train operation control system based on train-ground coordination according to claim 1, wherein the turnout resources are specifically subdivided as follows:

dividing resources of a turnout P1 into a P1-pre-turnout zone, a P1-turnout movable zone, a P1-forward side defense zone, a P1-reverse side defense zone, a P1-forward post-turnout zone, and a P1-reverse post-turnout zone.

6. The train operation control system based on train-ground coordination according to claim 5, wherein the subdivided resources are specifically managed as follows:

a) each subdivided zone is the smallest unit for train occupancy and clearance, can be occupied by one train each time, and can be occupied by another train after train clearance;

b) the P1-forward side defense zone and the P1-reverse side defense zone are mutually exclusive in terms of occupancy, and only one of the two can be occupied each time; and c) the P1-turnout movable zone can be unlocked by a train originally applying for locking and can be applied and operated by an additional train, as long as the P1-turnout movable zone is not occupied.

7. A method for controlling the train operation control system based on train-ground coordination according to claim 1, comprising the following steps:

1) First, managing, by the RMU for the ground train control equipment, the line resources and the turnout resources by section;

2) Then, performing communication between on-board CC of adjacent trains, and performing fine management on resources in a section to implement resource sharing between the trains; and 3) Finally, actively performing train control by the on-board CC according to the allocated resources to fulfill a train safety protection function and an automatic train driving function.

* * * * *